United States Patent [19]

Pomfret

[11] 4,370,951

[45] Feb. 1, 1983

[54] LIQUID COOLED MULTI-CYLINDER INTERNAL COMBUSTION ENGINE

[75] Inventor: Colin T. Pomfret, Graz, Austria

[73] Assignee: Hans List, Graz, Austria

[21] Appl. No.: 271,090

[22] Filed: Jun. 5, 1981

[30] Foreign Application Priority Data

Jun. 13, 1980 [AT] Austria ..... 3151/80

[51] Int. Cl.[3] ..... F01M 1/06

[52] U.S. Cl. ..... 123/41.74; 123/195 R; 123/196 AB

[58] Field of Search ..... 123/41.72, 41.74, 41.83, 123/196 R, 196 AB, 41.84, 195 R; 184/6.5-6.9

[56] References Cited

U.S. PATENT DOCUMENTS

| | | | |
|---|---|---|---|
| 1,218,132 | 3/1917 | Tuhey | 123/196 R |
| 2,681,054 | 6/1954 | Boghossian | 123/41.74 X |
| 4,033,312 | 7/1977 | Howe | 123/196 R |
| 4,294,203 | 10/1981 | Jones | 123/41.83 |

*Primary Examiner*—William A. Cuchlinski, Jr.
*Attorney, Agent, or Firm*—Watson, Cole, Grindle & Watson

[57] ABSTRACT

A liquid cooled multi-cylinder internal combustion engine comprises a crankcase which extends above the crankshaft axis and a cylinder block which is fixed to the upper edge of the crankcase by means of a connecting flange arranged on the cooling jacket. The engine has two-part crankshaft main bearings which are connected to the cylinder block by means of through bolts. The cooling jacket of the cylinder block is shorter than the cylinder liners, and adjacent to the cooling jacket and extending to the end of the cylinder liners downward opening conduits are formed which are communicating with each other. These conduits are tightly covered by a cover plate, which is arranged between the lower end of the cylinder block and the upper bearing parts and serve for the oil supply, especially of the crankshaft main bearings of the engine.

5 Claims, 2 Drawing Figures

LIQUID COOLED MULTI-CYLINDER INTERNAL COMBUSTION ENGINE

BACKGROUND OF THE INVENTION

The present invention relates to a liquid cooled multi-cylinder internal combustion engine having a crankcase which extends above the crankshaft axis, and which is fixed to a connecting flange located at the cooling jacket. The crankshaft main bearings of the engine consists of an upper and a lower bearing part which are fixedly connected to the cylinder block.

DESCRIPTION OF THE PRIOR ART

In conventional engines having crankshaft main bearings which are fixedly connected to the crankcase the distribution of the lubricant, especially to the crankshaft main bearings, is effected via bores arranged in the crankcase. These bores make the casing complicated and render its casting difficult. Still more complicated is the distribution of the lubricant in engines of the type mentioned above as the crankshaft main bearings are fixedly connected to the cylinder block and, via the flange arranged thereon, to the crankcase.

It is an object of the present invention to provide for a simple and suitable solution regarding the lubricant distribution in engines initially mentioned.

SUMMARY OF THE INVENTION

According to the invention this will be achieved in that the connecting surfaces of the cylinder block and the upper bearing parts are provided in the lower end plane of the cylinder liners, and in that the cooling jacket of the cylinder block is shorter than the cylinder liners, and further in that, adjacent to the cooling jacket and extending to the lower end of the cylinder liners, there are formed conduits communicating with each other which open downwards and have approximately the same width as the cooling jacket and which are tightly covered at their lower end by a cover plate arranged between the cylinder block and the upper bearing parts and serve for oil supply, especially to the crankshaft main bearings. The cooling jackets are shorter than the cylinders, so that the lowermost part of the cylinder which is not cooled is available for arranging the downward opening conduits according to the invention. The casting of a cylinder block of such a structure is extremely easy. Another advantage resides in that the oil warms up quicker than in known engines which results in an essential advantage concerning the fuel consumption of the engine, especially in city traffic. Additionally a unification of the temperature of the cylinder liners will occur which represents another advantage in view to wear and fuel consumption of the engine.

According to another embodiment of this invention the partition walls between the cooling jacket and the downward opening conduits are arranged in such an axial position that the unification of the temperature of the cylinder liners during operation of the engine is at an optimum.

According to another feature of the present invention the cover plate is fixed to the upper bearing parts of the crankshaft main bearings which has the advantage that the bearing parts remain in their appropriate position in the crankcase during a dismounting of the cylinder block.

Another embodiment of the present invention shows the cover plate fixed to just one of the upper bearing parts, whereas the remaining upper bearing parts are provided with fitting elements, such as fitting pins or fitting sleeves, so that the cover plate will keep these bearing parts accurately in the mounting position also in longitudinal direction.

In a further embodiment of the invention the crankshaft main bearings are suitably supplied with oil from the downward opening conduits via bores which pass through the cover plate and the upper bearing parts. The manufacture of these bores is simple, if it is provided for that the plate has been previously immovably connected to the upper bearing parts.

DESCRIPTION OF THE DRAWINGS

The present invention will hereinafter be further illustrated with reference to the accompanying drawings, wherein.

DESCRIPTION OF THE PREFERRED EMBODIMENT

Figure 1:
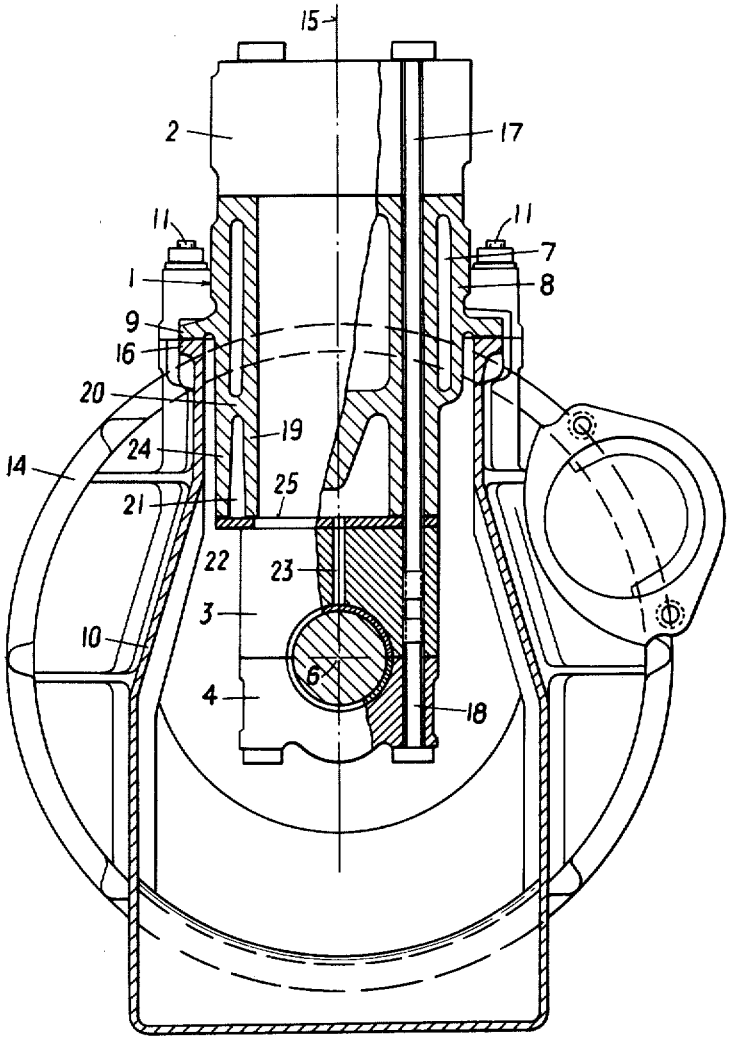
FIG. 1 shows a cross sectional view of an internal combustion engine according to the invention.
Figure 2:
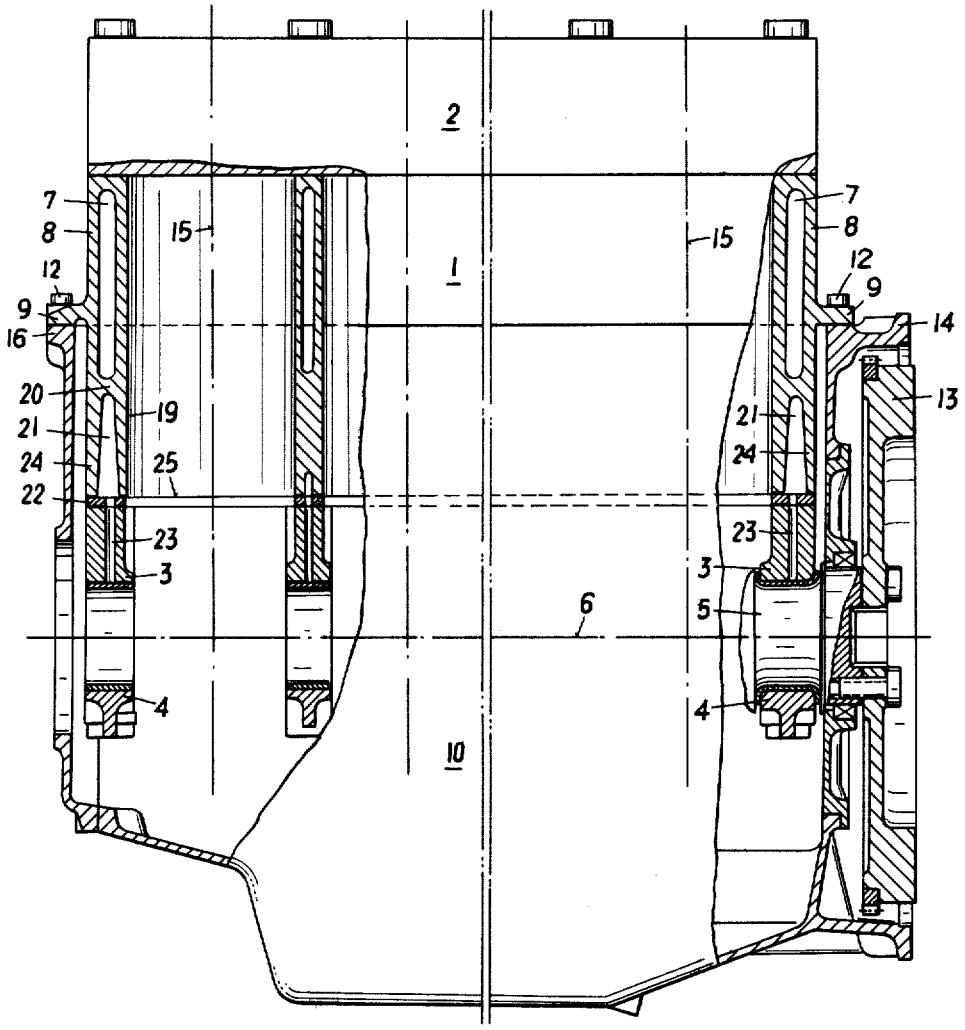
FIG. 2 shows a corresponding side view, partly in an axial section.

The depicted internal combustion engine is a water cooled four cylinder in-line engine with a cylinder block 1 and a cylinderhead 2 which are manufactured separately. Crankshaft main bearings are arranged on the cylinder block 1 and are constituted of two parts each, namely an upper bearing part 3 a lower bearing part 4. A corresponding journal pin 5 of the crankshaft has an axis 6 5.

The cylinderhead 1 has a surrounding connecting flange 9 which protrudes from the outer walls 8 in the region of the cylinder water jacket 7. A crankcase 10 is fixed to the flange 8 by means of screws 11, 12 and constitutes an oilpan. The crankcase 10 is formed as an integral casting together with a flywheel case 14 containing a flywheel 13. The connecting flange 9 of the cylinder block 1 is arranged in a plane perpendicular to the cylinder axes 15 of the engine, which plane has a distance from the crankshaft axis 6 which is at least half the diameter of the flywheel 13. The upper connecting flange 16 of the crankcase 10 and the upper end of the flywheel case 14, therefore, lie at approximately the same elevation height.

The upper bearing parts 3 of the crankshaft bearings are fixed to the cylinder block 1 by means of through bolts 17 which pass through the cylinderhead 2 and the cylinder block 1 and are screwed into the upper bearing parts 3. The lower bearing parts 4 of the crankshaft bearings are connected to the upper bearing parts 3 by means of screws 18, so that, after unscrewing the through bolts 17, the cylinder block 1 together with the cylinderhead 2 may be released thereby allowing an inspection of the cylinder liner 19 and the piston (not shown) in a simple way.

The lower end of the water jacket 7 surrounding the cylinder liner 19 is defined by a partition wall 20. Below this partition wall 20 there are downward opening conduits 21 communicating with each other, the lower ends of which are defined by the end plane 25 of the cylinder liners 19 and are sealed by a cover plate 22 consisting, e.g., of steel or aluminium. The external walls 24 of the conduits 21 are formed by an extension of the external walls 8 of the water jacket 7 of the cylinders. The crankshaft main bearings are supported with oil from these conduits 21 via bores 23 passing through the cover plate 22 and arranged in the upper bearing parts 3. The through bolts 17 bias the cover plate 22 so that a sufficient seal between conduits 21 as well as bores 23 and the crankshaft main bearings is achieved.

I claim:

1. Liquid cooled multi-cylinder internal combustion engine, comprising a cylinder block with cylinder liners and a cooling jacket, a connecting flange running about said cooling jacket, a crankshaft and a crankcase, which extends above the axis of said crankshaft and which is fixed to said connecting flange, crankshaft main bearings each comprising an upper part and a lower part and being fixed to said cylinder block, and wherein the connecting surfaces of said cylinder block and said upper bearing parts are provided in the lower end plane of said cylinder liners, said cooling jacket being shorter than said cylinder liners, and conduits for the oil supply of the engine are formed in the end of said cylinder block adjacent said cooling jacket, which are open downwards, communicating with each other, and having at least approximately the same width as said cooling jacket, and a cover plate being provided between said cylinder block and said upper bearing parts, which tightly covers said conduits.

2. Engine according to claim 1, wherein the partition walls between said cooling jacket and said downward opening conduits are arranged in such an axial position that the unification of the temperature of said cylinder liners during operation of the engine is at an optimum.

3. Engine according to claim 1 or 2, wherein said cover plate is mounted on said upper bearing parts.

4. Engine according to claim 3, wherein said cover plate is fixed to just one of said upper bearing parts whereas the remaining upper bearing parts are provided with fitting elements, such as fitting pins or fitting sleeves, so that, said cover plate keeps these bearing parts accurately in the mounting position also in longitudinal direction.

5. Engine according to claim 4, wherein said crankshaft main bearings are supplied with oil from said downward opening conduits via bores which pass through said plate and said upper bearing plates.

* * * * *